US011627824B2

(12) United States Patent
DiTrolio

(10) Patent No.: US 11,627,824 B2
(45) Date of Patent: Apr. 18, 2023

(54) FLAT-MOUNTED CONNECTOR FOR PIPES

(71) Applicant: Philip DiTrolio, Suwanee, GA (US)

(72) Inventor: Philip DiTrolio, Suwanee, GA (US)

( * ) Notice: Subject to any disclaimer, the term of this patent is extended or adjusted under 35 U.S.C. 154(b) by 131 days.

(21) Appl. No.: 16/931,556

(22) Filed: Jul. 17, 2020

(65) Prior Publication Data

US 2020/0383509 A1 Dec. 10, 2020

Related U.S. Application Data

(63) Continuation-in-part of application No. 29/739,477, filed on Jun. 25, 2020, and a continuation-in-part of application No. 15/727,695, filed on Oct. 9, 2017, now Pat. No. 10,941,560.

(60) Provisional application No. 62/876,222, filed on Jul. 19, 2019.

(51) Int. Cl.
*A47H 1/102* (2006.01)
*E04B 1/18* (2006.01)

(52) U.S. Cl.
CPC ..... *A47H 1/102* (2013.01); *E04B 1/185* (2013.01)

(58) Field of Classification Search
CPC . A47H 1/02; A47H 1/14; A47H 1/142; A47H 1/144; E04B 2001/2406; E04B 2001/2409; E04B 2001/2421; E04B 2/2403; E04B 2002/0236; E04B 1/5843; E04B 1/185; Y10T 403/34; Y10T 403/342; E04H 1/1272; F16B 2200/30
See application file for complete search history.

(56) References Cited

U.S. PATENT DOCUMENTS

| | | | | |
|---|---|---|---|---|
| 409,893 A | | 8/1889 | Wray | |
| 2,689,103 A | * | 9/1954 | Ackerman | A47H 1/122 248/257 |
| 3,480,243 A | * | 11/1969 | Summerville, Jr. | A47H 1/102 248/225.11 |
| 3,823,439 A | * | 7/1974 | Selset | A47H 15/04 16/95 D |

(Continued)

FOREIGN PATENT DOCUMENTS

| | | | | |
|---|---|---|---|---|
| DE | 202006001094 U1 | * | 6/2006 | A47K 3/38 |
| FR | 2546953 A1 | * | 12/1984 | E04B 1/24 |

OTHER PUBLICATIONS

U.S. Appl. No. 15/727,695 to DiTrolio filed Oct. 9, 2017.

(Continued)

*Primary Examiner* — Matthew R McMahon
(74) *Attorney, Agent, or Firm* — Johnson, Marcou, Isaacs & Nix, LLC

(57) ABSTRACT

A flat-mounted connector that enables industry standard hooks on horizontal rods to rest at such a height as to provide uniform appearance to the top of drape walls. The flat-mounted connector provides a connection that affixes to a flat wall or surface and an affixed coupler for the drape rods to be affixed to a vertical surface. The connector has an upper region with a similar outside dimension as the body of the coupler. In an internal portion of the coupler, at least one hollow well opens vertically with at least one lateral notch or opening formed in an upper region and designed to accept a terminal hook used on an end of a horizontally placed rod. An example connector includes two couplers affixed to the flat-mounted connection to accept additional terminal hooks.

12 Claims, 12 Drawing Sheets

(56) References Cited

U.S. PATENT DOCUMENTS

| | | | | |
|---|---|---|---|---|
| 4,019,298 | A | 4/1977 | Johnson, IV | |
| 4,261,138 | A | 4/1981 | St. George Syms | |
| 4,283,035 | A * | 8/1981 | Ojembarrena | A47H 1/142 248/263 |
| 4,723,384 | A | 2/1988 | Mengeringhausen | |
| 4,867,598 | A | 9/1989 | Winter, IV | |
| 4,951,438 | A | 8/1990 | Thoresen | |
| 5,111,631 | A | 5/1992 | Flood | |
| 5,289,665 | A | 3/1994 | Higgins | |
| 5,291,708 | A | 3/1994 | Johnson | |
| 5,433,416 | A | 7/1995 | Johnson | |
| 5,680,737 | A | 10/1997 | Sheipline | |
| 5,802,798 | A * | 9/1998 | Martens | E04B 1/1909 52/653.1 |
| 5,911,762 | A | 6/1999 | Ott | |
| 6,216,889 | B1 * | 4/2001 | Chang | A47H 1/122 211/105.1 |
| 6,837,016 | B2 | 1/2005 | Simmons | |
| 6,840,482 | B2 * | 1/2005 | Downey | A47H 1/14 248/262 |
| 6,952,905 | B2 | 10/2005 | Nickel | |
| 6,969,211 | B2 | 11/2005 | Altman | |
| 7,198,088 | B2 * | 4/2007 | McMenamin | E06B 9/38 160/123 |
| 8,020,328 | B2 * | 9/2011 | Lavi | A47F 5/105 40/605 |
| 8,209,924 | B2 | 7/2012 | Foley | |
| 8,209,925 | B2 | 7/2012 | Foley | |
| 8,231,093 | B2 * | 7/2012 | Tran | A47H 1/142 248/262 |
| 9,211,027 | B2 | 12/2015 | Ovist | |
| 9,271,593 | B1 * | 3/2016 | Chang | A47H 1/022 |
| 10,702,085 | B1 * | 7/2020 | Newport | E04F 11/18 |
| 10,765,247 | B2 * | 9/2020 | Moss | A47H 1/102 |
| 2002/0162929 | A1 * | 11/2002 | Downey | A47H 1/14 248/262 |
| 2005/0098272 | A1 * | 5/2005 | Rizzo | A47H 1/14 160/38 |
| 2006/0165482 | A1 | 7/2006 | Olberding | |
| 2006/0278777 | A1 * | 12/2006 | Atkinson | A47B 13/021 248/188.4 |
| 2018/0119410 | A1 | 5/2018 | Ditrolio | |

OTHER PUBLICATIONS

U.S. Appl. No. 17/031,274 to DiTrolio filed Sep. 24, 2020.
U.S. Appl. No. 29/739,477 to DiTrolio filed Jun. 25, 2020.
U.S. Appl. No. 17/099,534 to DiTrolio filed Nov. 16, 2020.
U.S. Appl. No. 17/188,118 to DiTrolio filed Mar. 1, 2021.
U.S. Appl. No. 17/188,230 to DiTrolio filed Mar. 1, 2021.
"Final Office Action in U.S. Appl. No. 15/727,695, filed Oct. 9, 2017", dated Aug. 21, 2020, 15 pages.
"Office Action in U.S. Appl. No. 15/727,695, filed Oct. 9, 2017", dated Mar. 4, 2020, 16 pages.

* cited by examiner

100

200

200

200

FLAT-MOUNTED CONNECTOR FOR PIPES

CROSS-REFERENCE TO RELATED APPLICATIONS

This application claims priority to U.S. Provisional Patent Application No. 62/876,222, filed Jul. 19, 2019, and entitled "Flat-Mounted Connector for Pipes." This application also is a continuation-in-part and claims priority to U.S. Design Application No. 29/739,477 filed Jun. 25, 2020, and entitled "Connector Accessory for Pipes, and is a continuation-in-part of and claims priority to U.S. application Ser. No. 15/727,695, filed Oct. 9, 2017, and entitled "Connector for Pipes." The entire contents of the above-identified applications are hereby fully incorporated herein by reference.

FIELD OF INVENTION

The present disclosure relates to couplers for drape rods of the type typically found in exhibit booths. Specifically, the present disclosure relates to a universal coupler for coupling transverse drape rods to fixed location supports for creating exhibit booths. Further, the present disclosure relates to one or more couplers adapted to be affixed via a flat-mounted connector support.

BACKGROUND

In the prior art, exhibit booths and the like are constructed using a tubular framework supporting drapes as walls and or covers. Many of these booths are constructed using a hook-and-slot system, which utilize upright aluminum poles with slots formed near the top regions thereof for receiving hooks secured to and extending from the ends of horizontally-positioned tubular rods. Draping material is placed over the horizontal rods to form booths or partitions as may be required. Pipe and drape walls traditionally have a bumpy appearance due to the height difference of the vertical members in relation to the top of horizontally disposed connecting rods. Additionally, the steel hooks on industry standard horizontal drape rods have a tendency to "tear" the aluminum vertical uprights in a "can opener" effect when the steel hooks are inserted in the existing slots in the uprights. Past attempts to solve these problems involve proprietary connectors that are not compatible with the standard steel hooks.

SUMMARY OF THE INVENTION

The present flat-mounted connector enables industry standard hooks on horizontal rods to rest at such a height as to provide uniform appearance to the top of drape walls. The flat-mounted connector includes a coupler for the drape rods to be affixed to a vertical surface, such as a wall. The coupler has an upper region with a similar outside dimension as the body of the coupler. In an internal portion of the coupler, at least one hollow well opens vertically with at least one lateral notch or opening formed in the upper region and designed to accept a terminal hook used on an end of a horizontally placed rod. The coupler prevents the steel hooks on industry standard horizontal drape rods from tearing into the support pipes. The coupler allows for the industry standard hooks to be inserted at a wider angle of insertion and easier connection than conventional industry standard slots.

The flat-mounted connector allows one or more of the couplers to be mounted to a flat surface via a connection bridge that connects a flat connecting plate to one or more of the connectors. In an example, the couplers may be in series extending perpendicular from the flat connecting plate. In certain other example aspects described herein, methods to prepare and install the flat-mounted connector are provided.

These and other aspects, objects, features, and advantages of the example embodiments will become apparent to those having ordinary skill in the art upon consideration of the following detailed description of illustrated example embodiments.

DETAILED DESCRIPTION

The example embodiments described herein provide a flat-mounted connector 100 with one or more couplers 10 for connecting substantially orthogonally disposed rods to vertical flat surfaces in a pipe and drape exhibit booth construction. The "Pipe and Drape" industry, is a subset of exhibition and convention services in which frameworks are constructed from horizontally and vertically disposed members in such a fashion to allow draperies or curtains to hang and create division of space in convention halls or other similar areas by arranging drapery walls and booths. The flat-mounted connector 100 is designed to provide an improvement to form and function over the industry standard hook and slot technology, yet allow users of existing systems to continue using their inventory of components. In examples, one or more couplers 10 are connected to a wall connector 19 that can be mounted to a wall or other flat surface. The couplers 10 may be mounted in series perpendicular to the wall connector 19, in parallel to the wall connector 19, or in any other suitable configuration. In examples herein, when one coupler 10 is being described, two or more couplers 10 in any configuration may be envisioned to operate substantially similarly.

Figure 1:
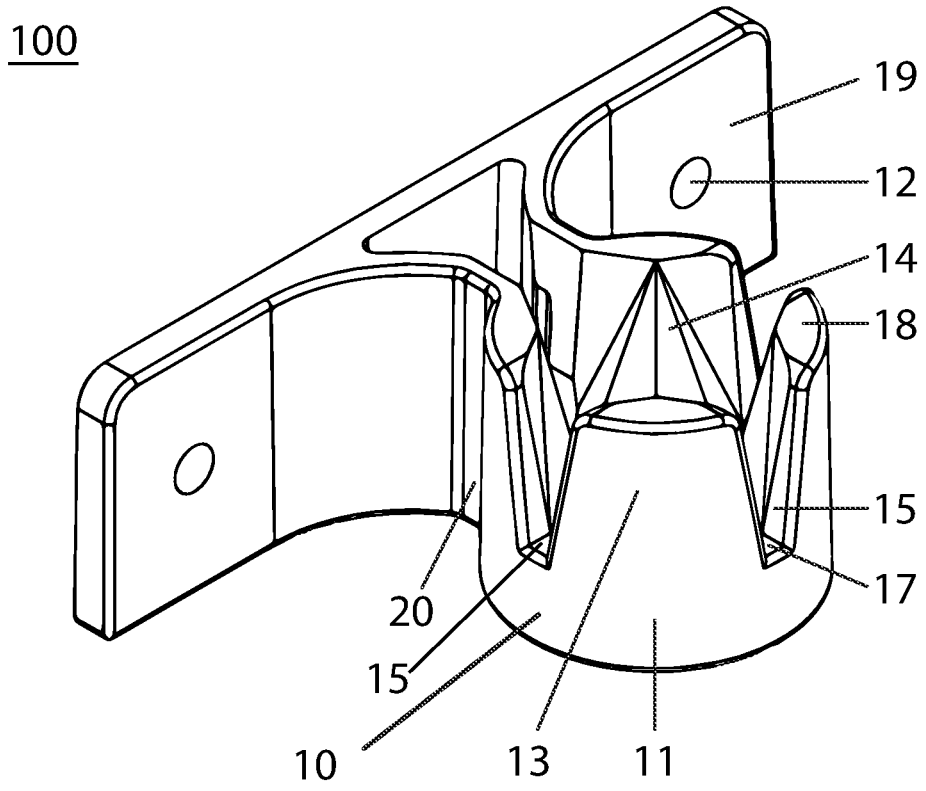
FIG. 1 is a perspective view of one embodiment of the flat-mounted connector with a single coupler.
Figure 3:
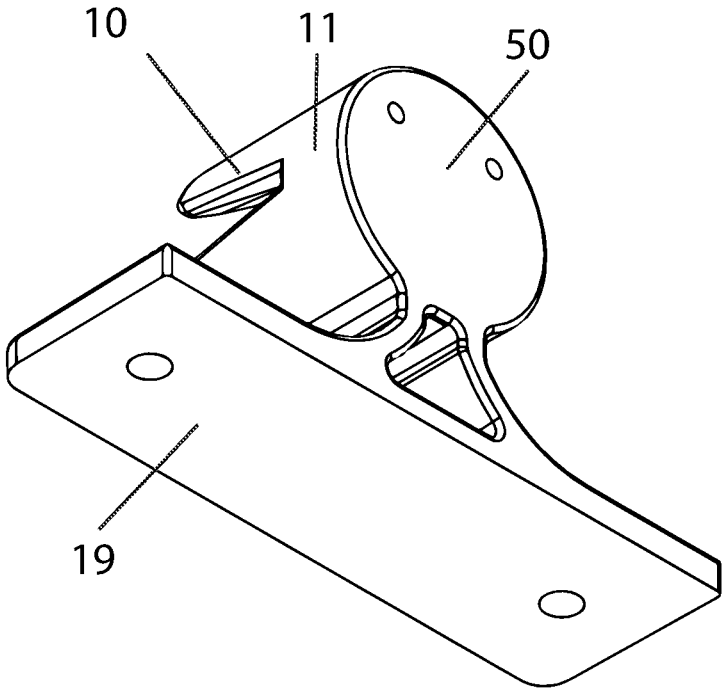
FIG. 3 is a perspective view of one embodiment of the flat-mounted connector with a single coupler.
Figure 4:
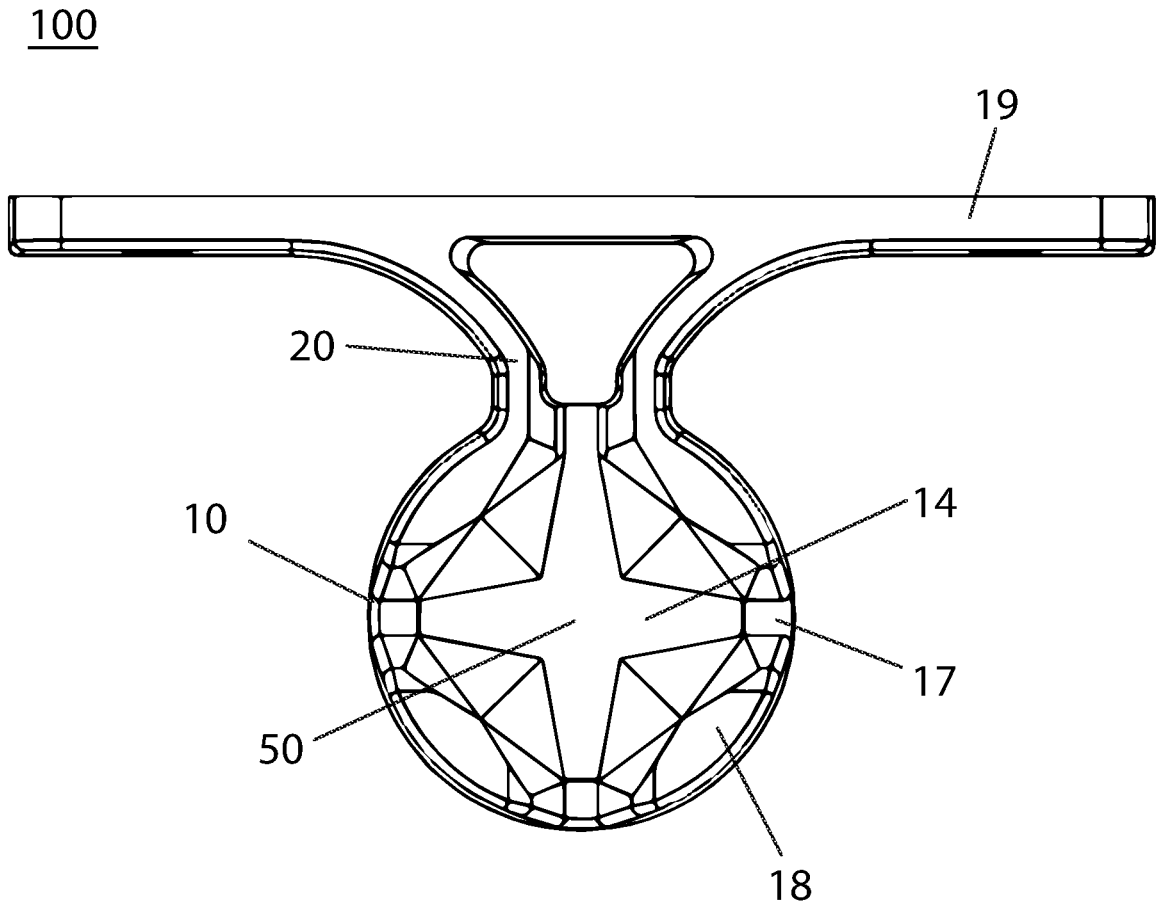
FIG. 4 is a top view of one embodiment of the flat-mounted connector with a single coupler.

FIG. 1 is a perspective view of one embodiment of the flat-mounted connector 100 with a single coupler 10. The assembly is a flat-mounted connector 100 used to construct the aforesaid pipe and drape booths. Because the steel terminal hooks traditionally used on the transverse rods to connect to the vertical member or a wall are used to connect to the instant coupler 10, the steel hooks are not illustrated. Coupler 10 has a body 11 and an upper region 13. The body 11 may be substantially circular. In alternate embodiments, the body 11 is another shape, such as square, hexagonal, or oblong. The upper region 13 may be of a similar outside dimension as the body 11 and/or of similar shape as the body 11. In an example, the upper region 13 is affixed to the body 11 or is molded, cast, or otherwise formed as a solitary piece or unit. In an internal portion of the coupler 10, at least one hollow well 14 opens vertically with at least one lateral notch or opening 15 formed in upper region 13 and designed to accept a terminal hook used on an end of a horizontally placed rod. The hollow well 14 may be an open space surrounded continuously or periodically by the upper region 13. The hollow well 14 is open at a top portion to receive terminal hooks. The coupler 10 may be hollow such that the upper region 13 and the body 11 are formed as hollow rings without a floor. Alternatively, the coupler 10 may have a floor 50 formed within as shown in FIG. 3 and FIG. 4.

The opening 15 is preferably formed in the upper region 13 with a wider upper dimension and tapers to a narrower seat 17 at the bottom of opening 15. The seat 17 is positioned at a height above an internal floor 50, if present (as illustrated in FIGS. 3 and 4), of the hollow well 14 to allow industry standard terminal hooks to rest on the seat 17 within opening 15 and hollow well 14 such that, when used as a rod and drape booth framework, the drapery walls have a uniform, flat appearance and the hooks are securely retained in the opening 15. Upper region 13 has a thickness at seat 17 that is sufficient to engage and retain the terminal hooks of the horizontal rods.

The top surfaces 18 of the coupler 10 are preferably rounded but may be beveled or flat. Similarly, the tapering surfaces of opening 15 may be beveled, rounded, or flat. Beveled, rounded, or other surfaces on the top surfaces 18 and the opening 15 may be used to facilitate the sliding of the terminal hooks into the opening 15.

The coupler 10 is attached to a wall connector 19 via a connection bridge 20. The connection bridge 20 may connect to the coupler 10 at the body 11 of the coupler 10, at the upper region 13, or in any combination of the two. The opposite end of the connection bridge 20 may connect to the body of a wall connector 19 in any suitable manner. For example, the connection bridge 20 is depicted as being affixed to the wall connector 19 and/or the coupler 10. The connection bridge 20 may be affixed or adhered to the wall connector 19 and/or the coupler 10 by screws, an adhesive, or any other connection method. Alternatively, the connection bridge 20, the wall connector 19, and/or the coupler 10 may be molded, cast, or otherwise formed as a solitary piece or unit.

The wall connector 19 may be flat, curved or in any other way shaped to connect to a surface such as a wall, a pillar, a frame, or any other suitable surface. The wall connector 19 may be shaped in a rectangle, as shown, or alternatively may be round, hexagonal, or any other suitable shape. The wall connector 19 is illustrated with two holes 12 for accepting a connector appliance, such as a screw, a bolt, or other suitable connector. Any number or placement of holes may be utilized to ensure that a secure mounting to the surface is achieved. In an example, screws are inserted through the holes 12 and into the flat surface of a wall or plate. The wall connector 19 is secured flat against the wall. In another example, the wall connector is affixed to the flat surface via an adhesive, a locking mechanism, a clip, or any other suitable mechanism.

When the coupler 10 is affixed to a flat surface, such as a wall, the hollow well 14 of the coupler 10 is disposed upwards to accept the hooks or other drape hardware for display. In an example, the wall is a flat surface that is positioned vertically and the coupler 10 is affixed normal to the plane of the wall. In another example, the wall is at a different angle than vertical and the coupler 10 is disposed at an angle to the wall connector 19 such that the hollow well 14 is still directed upwards vertically. That is, the wall connector 19 may be affixed via the connection bridge 20 at any angle to allow the coupler 10 to still be used vertically.

Preferably, coupler 10 will be made from durable reinforced polymer material, acrylonitrile butadiene styrene plastic, Delrin, polyurethane, or some other suitable material that has sufficient strength had rigidity to effectuate the connection.

Figure 2:
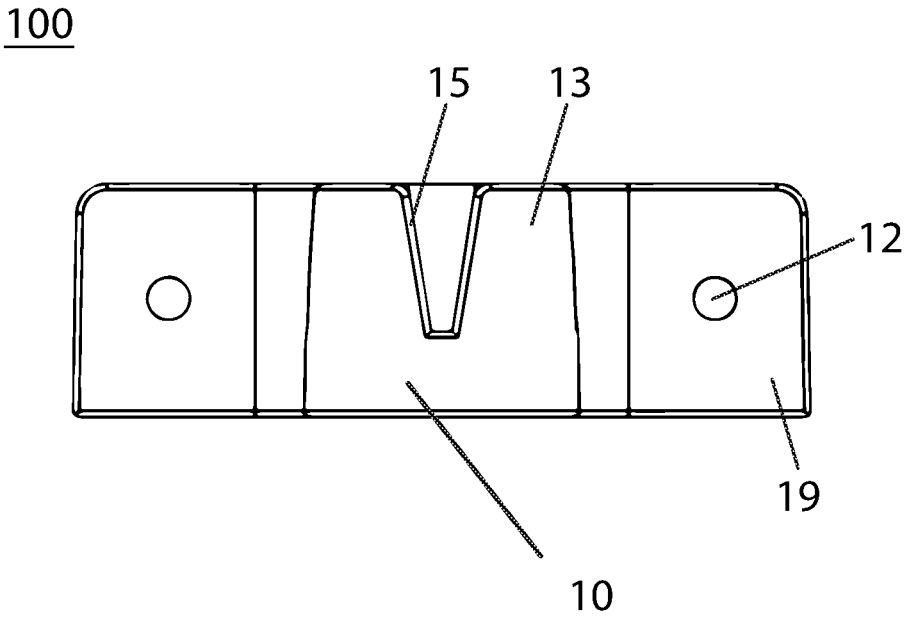
FIG. 2 is a front elevation of one embodiment of the flat-mounted connector with a single coupler.

FIG. 2 is a front elevation of one embodiment of the flat-mounted connector 100 with a single coupler 10. The wall connector 19 is shown affixed behind the coupler 10. The opening 15 and the upper region 13 are shown opened in the vertical direction to accept a hook from above. The holes 12 are illustrated as being directly through the wall connector 19 to allow connection to a vertical surface.

FIG. 3 is a perspective view of one embodiment of the flat-mounted connector 100 with a single coupler 10. FIG. 3 provides a perspective view of the bottom of the flat-mounted coupler. The wall connector 19 is shown affixed behind the coupler 10. The floor 50 of the coupler 10 is shown connected to a perimeter wall of the body 11. The floor 50 forms the bottom of the hollow well 14, as depicted in FIG. 1. The surface of the floor 50 may be solid, perforated, or formed in any suitable manner, such as a grid.

FIG. 4 is a top plan view of one embodiment of the flat-mounted connector 100 with a single coupler 10. The coupler 10 is illustrated attached to a wall connector 19 via a connection bridge 20. The seat 17 is illustrated as adjacent to, and higher than, the internal floor 50. The internal floor is disposed beneath the hollow well 14. The top surfaces 18 are shown as facing upwards vertically, normal to the wall or rounded or beveled to direct terminal hooks towards the seat 17.

Figure 5:
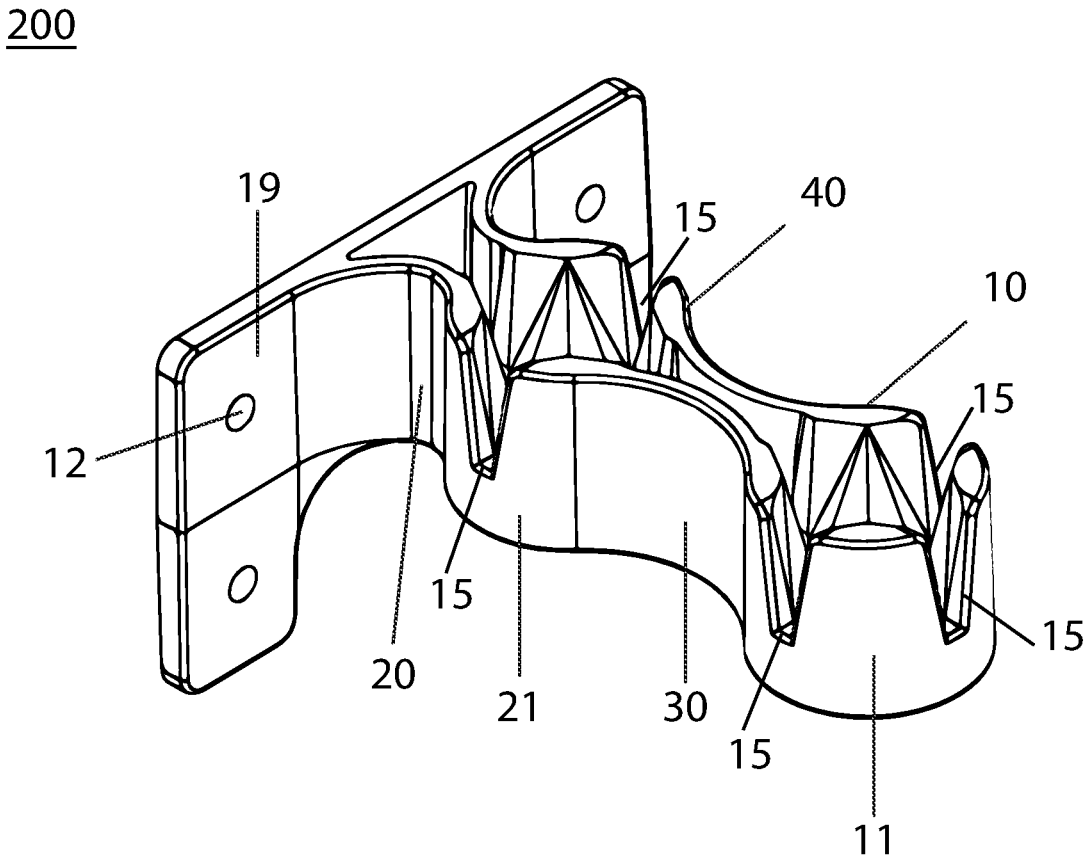
FIG. 5 is a perspective view of one embodiment of the flat-mounted connector with two couplers.

FIG. 5 is a perspective view of one embodiment of the flat-mounted connector 200 with two couplers 10 and 40. In the example, the two couplers 10, 40 are disposed in series normal to the flat wall connector 19 of the flat-mounted connector 200. The first coupler 40 in the series is connected to the wall connector 19 via a connection bridge 20. The connection bridge 20 functions to affix the coupler 40 to the wall connector 19 as described with respect to the connection bridge 20 in FIG. 1.

The coupler 40 performs substantially the same functions as coupler 10. Coupler 40 has a connection bridge 30 affixed to the opposite side of the coupler 40 from the connection bridge 20. The second connection bridge 30 as depicted is in place of an opening 15. That is, instead of a third opening 15 as depicted in the coupler 10, the coupler 40 includes only two openings 15.

The connection bridge 20 connects to the coupler 40 at the body 21 of the coupler 40 or in any other suitable location. The opposite end of the connection bridge 20 may connect to the body of a wall connector 19 in any suitable manner. For example, the connection bridge 20 is depicted as being affixed to the wall connector 19 and/or the coupler 40. The connection bridge 20 may be affixed or adhered to the wall connector 19 and/or the coupler 40 by screws, an adhesive, or any other connection method. Alternatively, the connection bridge 20, the wall connector 19, and/or the coupler 40 may be molded, cast, or otherwise formed as a solitary piece or unit.

The connection bridge 30 is depicted as connecting the second coupler 10 to the coupler 40. In this example, the second connection bridge 30 is connected to the coupler 10 substantially the same as the connection bridge 20, as described in FIG. 1. The connector bridges 20, 30 and the couplers 10, 40 allow the wall mounted connector to extend the reach of the coupler 10 farther from the wall and also allow more terminal hooks to be affixed to the wall mounted connector. This configuration allows two or more rows of drapes to be affixed to the wall and, in an example, in parallel to the wall.

The wall connector 19 is illustrated with three visible holes 12 for accepting a connector, such as a screw, a bolt, or other suitable connector. The wall connector 19 may be larger and/or have more holes 12 to support the greater torque created by the additional connector bridge 30 and the two couplers 10, 40.

In examples, the connection bridges 20, 30, the wall connector 19, and/or the couplers 10, 40 may be molded, cast, or otherwise formed as a solitary piece or unit or affixed together in any other suitable manner, such as screws or adhesive.

Figure 6:
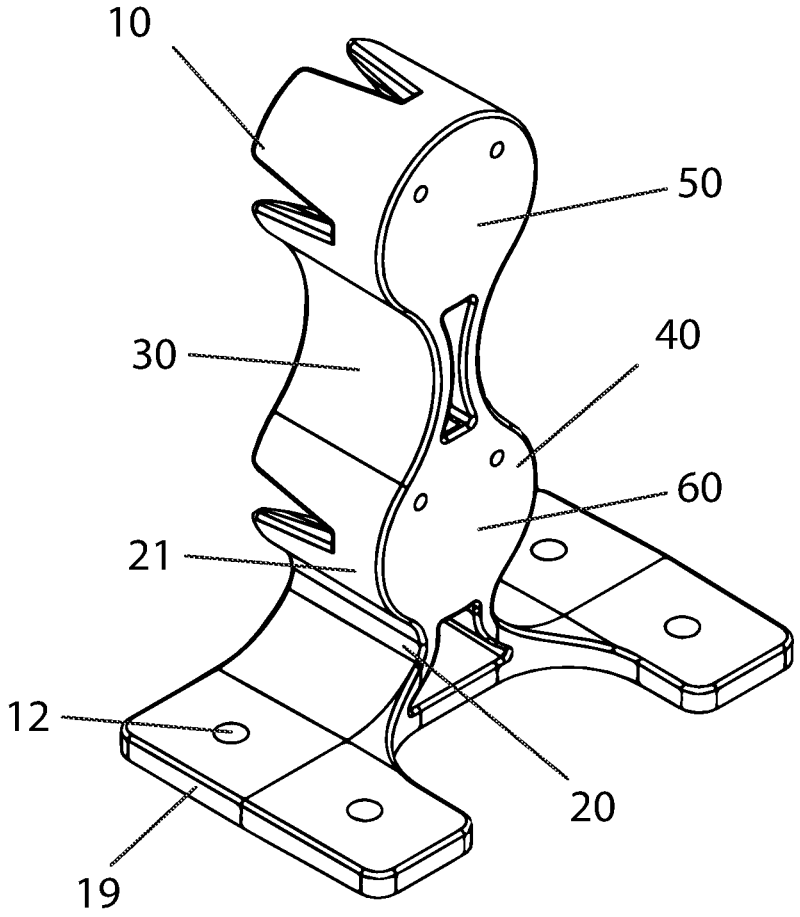
FIG. 6 is a perspective view of one embodiment of the flat-mounted connector with two couplers.

FIG. 6 is a perspective view of one embodiment of the flat-mounted connector 200 with two couplers 10, 40. FIG. 6 provides a perspective view of the bottom of the flat-mounted coupler. The wall connector 19 is shown affixed behind the coupler 40 via the connection bridge 20. The floor 60 of the coupler 40 is shown connected to a perimeter wall of the body 21. The floor 60 forms the bottom of the hollow well of the coupler 40. The surface of the floor 60 may be solid, perforated, or formed in any suitable manner, such as a grid.

The connection bridge 30 is depicted as connecting the coupler 10 to the coupler 40. In this example, the connection bridge 30 is connected to the coupler 10 substantially the same as the connection bridge 20, as described in FIG. 1. The floor 50 of the coupler 10 is shown connected to a perimeter wall coupler 10. The floor 50 forms the bottom of the hollow well of the coupler 10. The surface of the floor 50 may be solid, perforated, or formed in any suitable manner, such as a grid.

The connector bridges 20, 30 and the couplers 10, 40 allow the wall mounted connector to extend the reach of the coupler 10 farther from the wall and also allows more terminal hooks to be affixed to the wall mounted connector. The wall connector 19 is illustrated with four visible holes 12 for accepting a connector, such as a screw, a bolt, or other suitable connector. The wall connector 19 may be larger and/or have more holes 12 to support the greater torque created by the additional connector bridge 30 and the two couplers 10, 40.

Figure 7:
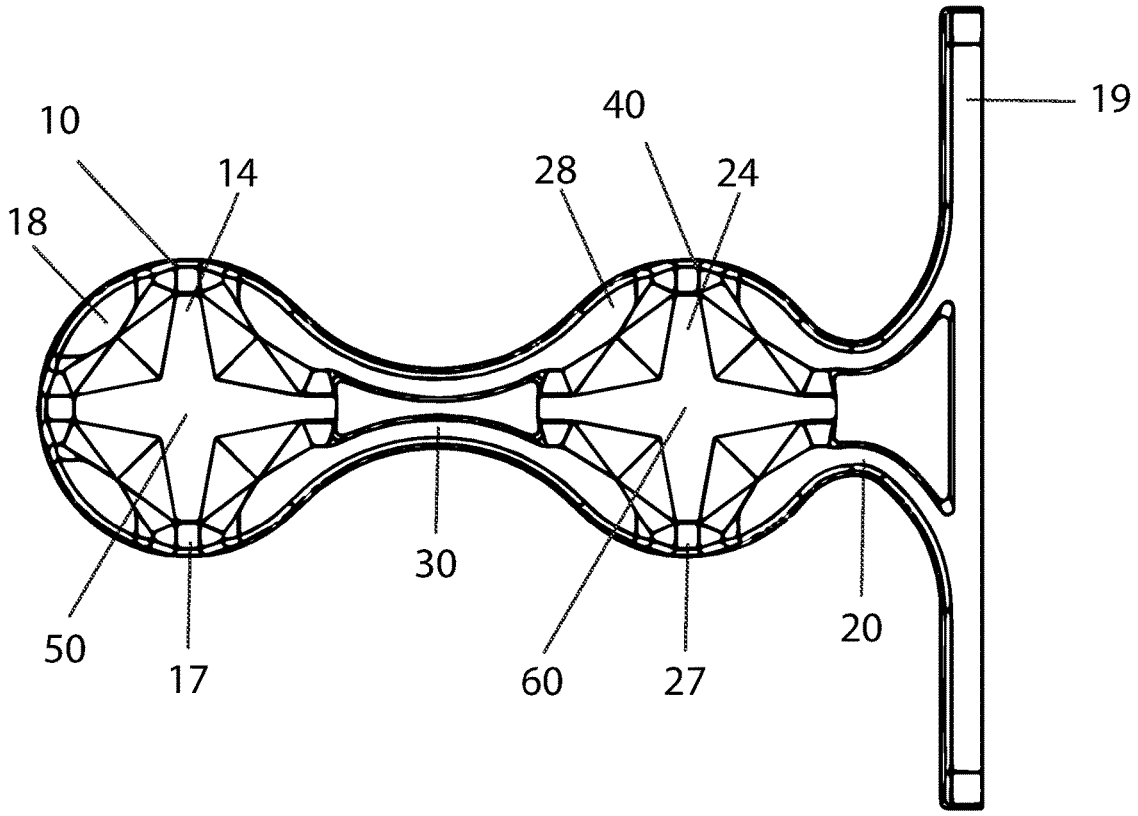
FIG. 7 is a top plan view of one embodiment of the flat-mounted connector with two couplers.

FIG. 7 is a top plan view of one embodiment of the flat-mounted connector 200 with two couplers 10, 40. FIG. 7 depicts a wall connector 19 connected to a connection bridge 20. The connection bridge 20 is connected to a coupler 40. The coupler 40 is connected to a connection bridge 30. The connection bridge 30 is connected to a coupler 10.

The coupler 40 is depicted with a seat 27 as adjacent to, and higher than, the internal floor 60. The internal floor 60 is disposed beneath the hollow well 24. The top surfaces 28 are shown as facing upwards vertically, normal to the wall or rounded or beveled to direct terminal hooks towards the seat 27. Coupler 40 includes similar features as coupler 10 to perform similar functions. As depicted in FIG. 7, the connection bridge 20 is at the three o'clock position on the coupler 40 and connection bridge 30 is at the nine o'clock position. In alternate examples, the connection bridge 30 may extend from any other position of the coupler 40, such as six o'clock or twelve o'clock. Alternatively, the connection bridge 30 may extend from the coupler 40 at another angle, such as at a 45-degree angle between six o'clock and 9 o'clock.

The seat 17 of coupler 10 is illustrated as adjacent to, and higher than, the internal floor 50. The internal floor being disposed beneath the hollow well 14. The top surfaces 18 are shown as facing upwards vertically, normal to the wall or rounded or beveled to direct terminal hooks towards the seat 17.

Figure 8:
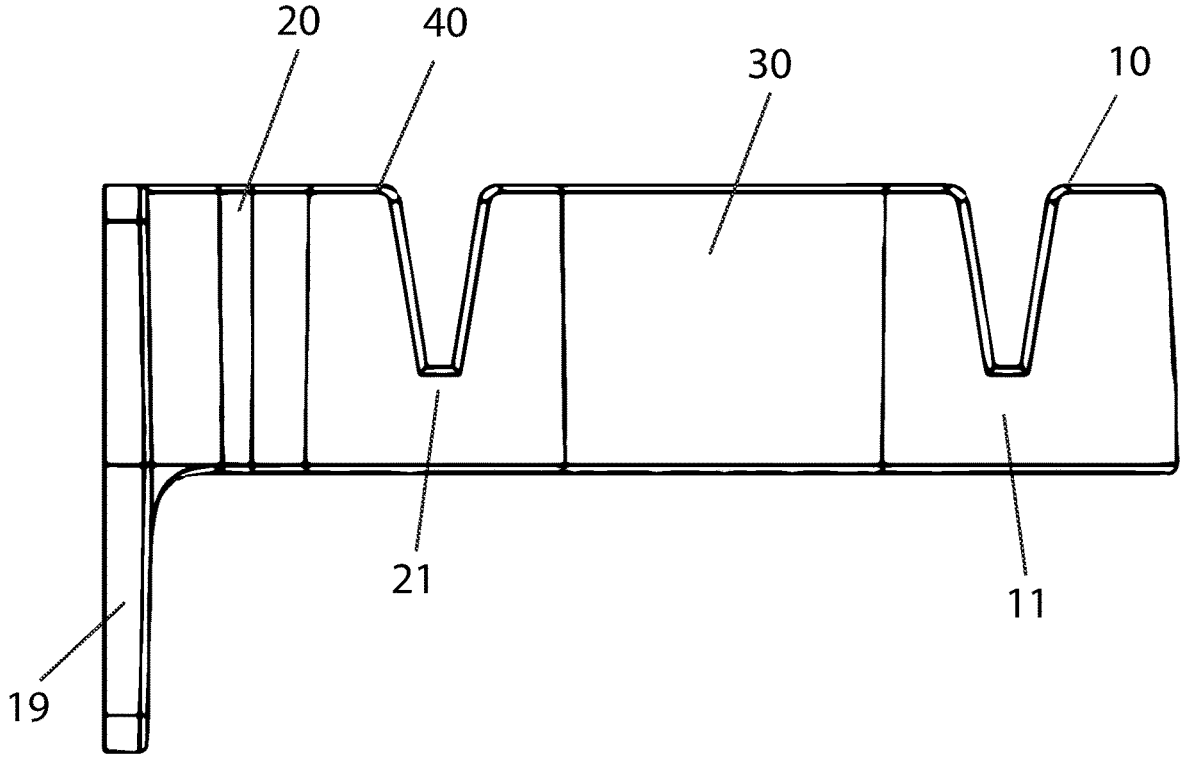
FIG. 8 is a side elevation of one embodiment of the flat-mounted connector with two couplers.

FIG. 8 is a side elevation of one embodiment of the flat-mounted connector 200 with two couplers 10, 40. The wall connector 19 is shown affixed to the connection bridge 20. The connection bridge 20 is connected to a coupler 40 at the body 21. The coupler 40 is connected to a connection bridge 30. The connection bridge 30 is connected to a coupler 10 at the body 11.

Figure 9:
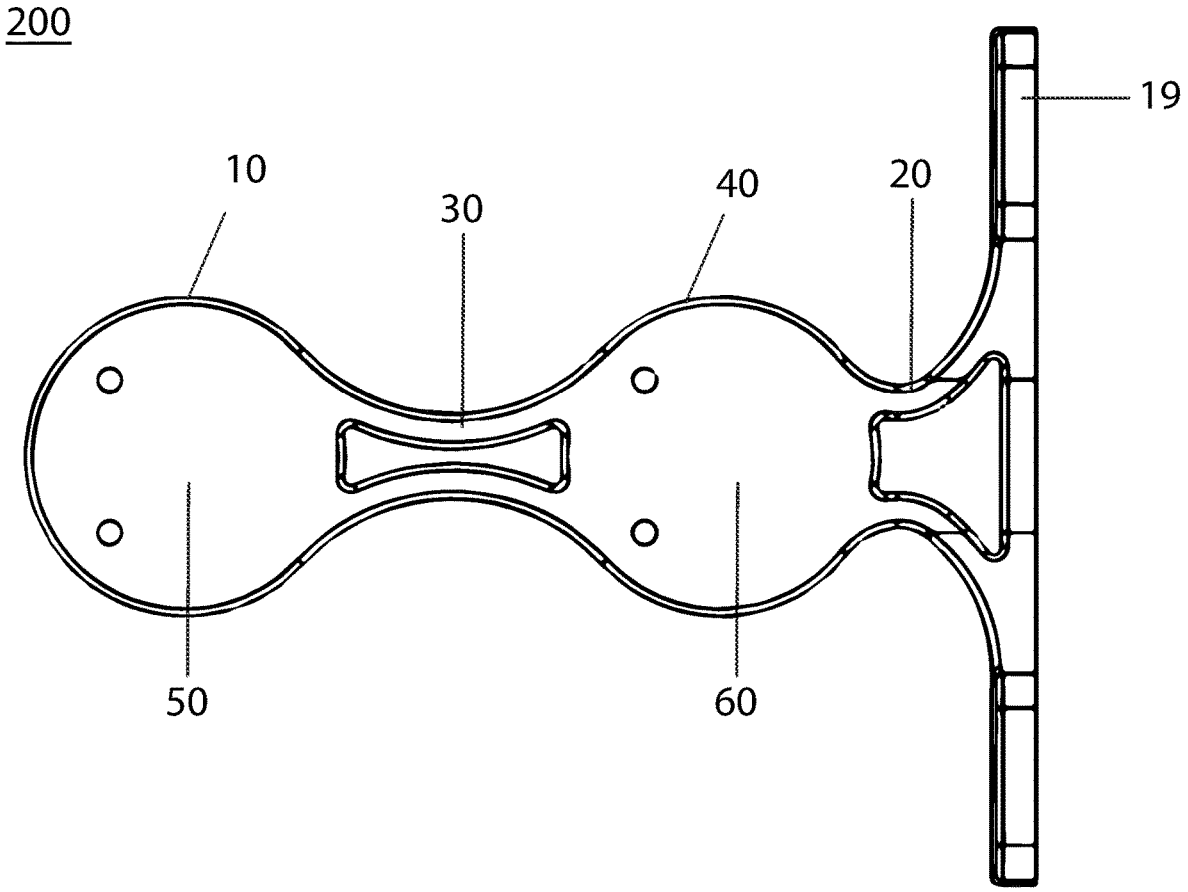
FIG. 9 is a bottom plan view of one embodiment of the flat-mounted connector with two couplers.

FIG. 9 is a bottom plan view of one embodiment of the flat-mounted connector 200 with two couplers 10, 40. The wall connector 19 is shown affixed to the connection bridge 20. The connection bridge 20 is connected to a coupler 40. The floor 60 of the coupler 40 is depicted. The coupler 40 is connected to a connection bridge 30. The connection bridge 30 is connected to a coupler 10. The floor 50 of the coupler 10 is depicted.

Figure 10:
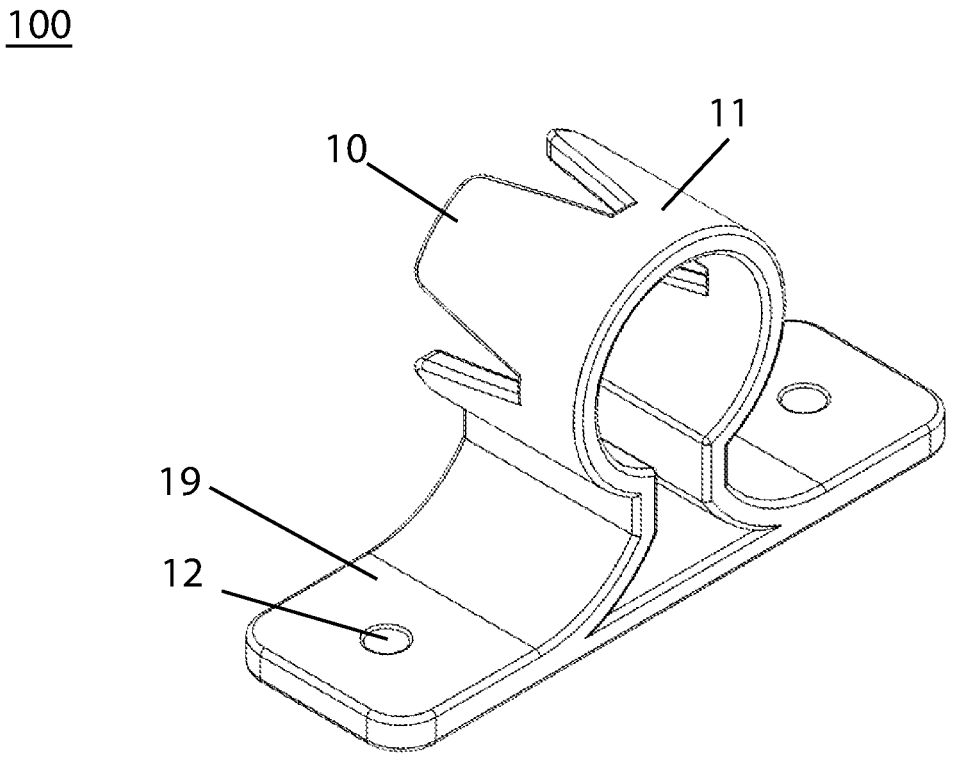
FIG. 10 is a perspective view of one embodiment of the flat-mounted connector with a single coupler with a longitudinal bore extending through the coupler.

FIG. 10 is a perspective view of one embodiment of the flat-mounted connector 100 with a single coupler 10 with a longitudinal bore extending through the coupler 10. Coupler 10 has body 11. The holes 12 are illustrated as being directly through the wall connector 19 to allow connection to a vertical surface.

Figure 11:
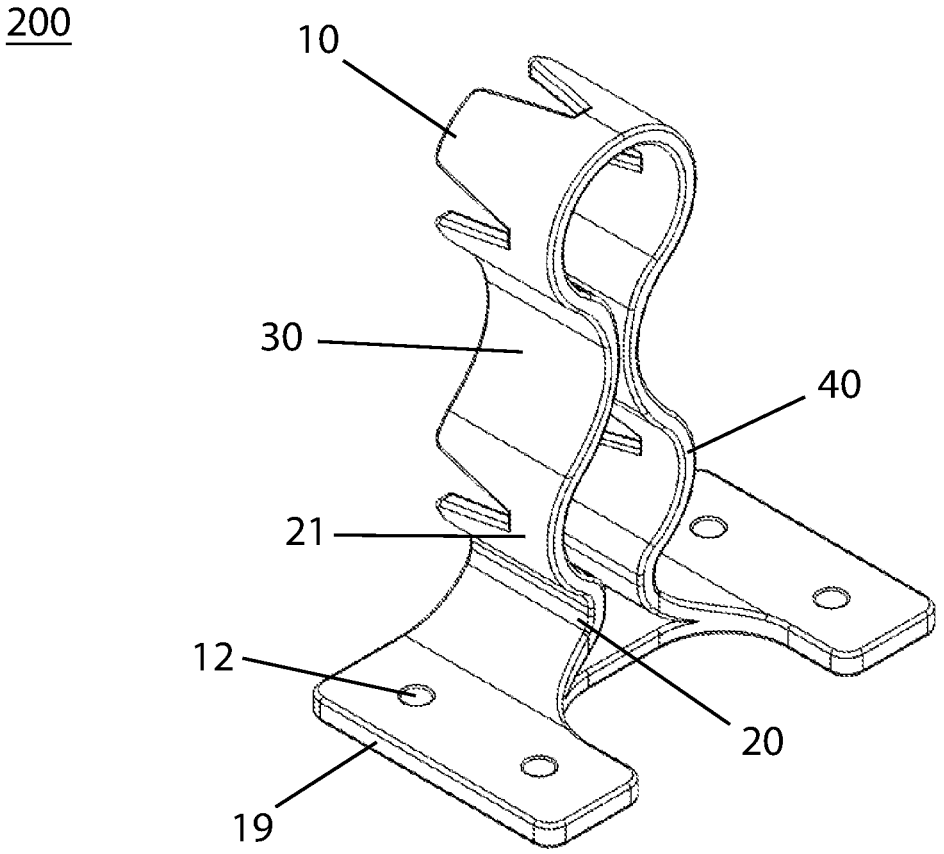
FIG. 11 is a perspective view of one embodiment of the flat-mounted connector with two couplers with a longitudinal bore extending through each coupler.

FIG. 11 is a perspective view of one embodiment of the flat-mounted connector 200 with two couplers 10, 40 with a longitudinal bore extending through each coupler 10, 40. In the example, the two couplers 10, 40 are disposed in series normal to the flat wall connector 19 of the flat-mounted connector 200. The first coupler 40 in the series with body 21 is connected to the wall connector 19 via a connection bridge 20. The connection bridge 20 functions to affix the coupler 40 to the wall connector 19 as described with respect to the connection bridge 20 in FIG. 1. Coupler 40 has a connection bridge 30 affixed to the opposite side of the coupler 40 from the connection bridge 20. The wall connector 19 is illustrated with four visible holes 12 for accepting a connector, such as a screw, a bolt, or other suitable connector.

Figure 12:
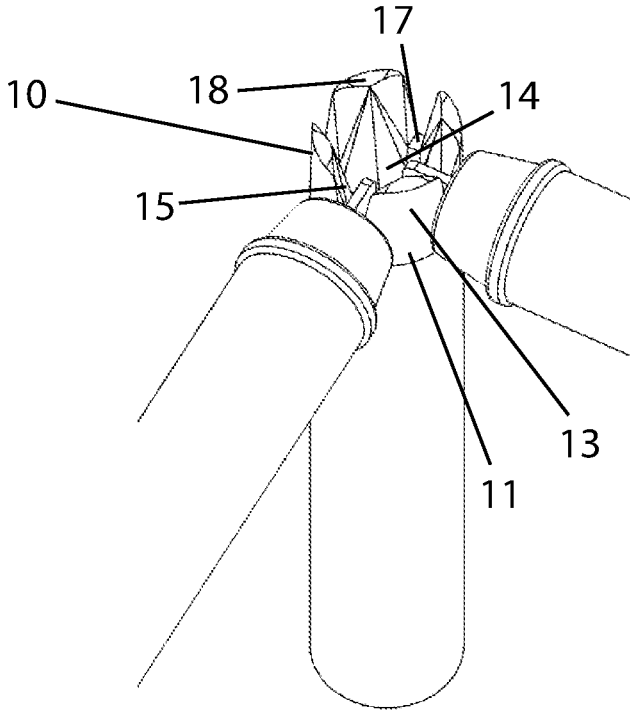
FIG. 12 is a top plan view of industry standard rods with terminal hooks affixed to a coupler.

FIG. 12 is a top plan view of industry standard rods with terminal hooks affixed to a coupler. Coupler 10 has a body 11 and an upper region 13. In an internal portion of the coupler 10, at least one hollow well 14 opens vertically with at least one lateral notch or opening 15 formed in upper region 13 and designed to accept a terminal hook used on an end of a horizontally placed rod. The opening 15 is preferably formed in the upper region 13 with a wider upper dimension and tapers to a narrower seat 17 at the bottom of opening 15. In an example, the top surfaces 18 of the coupler 10 are rounded. In another example, the top surfaces may be beveled or flat.

The example systems, methods, and acts described in the embodiments presented previously are illustrative, and, in alternative embodiments, certain acts can be performed in a different order, in parallel with one another, omitted entirely, and/or combined between different example embodiments, and/or certain additional acts can be performed, without departing from the scope and spirit of various embodiments. Accordingly, such alternative embodiments are included in the inventions described herein.

Although specific embodiments have been described above in detail, the description is merely for purposes of illustration. It should be appreciated, therefore, that many aspects described above are not intended as required or essential elements unless explicitly stated otherwise. Modifications of, and equivalent components or acts corresponding to, the disclosed aspects of the example embodiments, in addition to those described above, can be made by a person of ordinary skill in the art, having the benefit of the present disclosure, without departing from the spirit and scope of embodiments defined in the following claims, the scope of which is to be accorded the broadest interpretation so as to encompass such modifications and equivalent structures.

What is claimed is:

1. A connector for tubular members, comprising:

a flat-mounted connector and a coupler affixed thereto, the flat-mounted connector comprising two or more openings to receive two or more connector appliances to affix the flat-mounted connector to a vertical flat surface, the coupler comprising an upper region connected to the flat-mounted connector capable of being affixed to the vertical flat surface, the upper region encompassing a well formed within a body of the upper region such that the well is an upwardly opening well when the flat-mounted connector is affixed to the vertical flat surface, the upwardly opening well of the upper region defining a plurality of upwardly opening slots disposed therein with each slot sized to receive therein a terminal connector connected to a drape rod, and the plurality of upwardly opening slots disposed to accept the terminal connector connected to the drape rod in parallel and perpendicular directions relative to a surface plane of the flat-mounted connector when affixed to the vertical flat surface.

2. The connector as defined in claim 1, wherein the upwardly opening well is a longitudinal bore extending through the coupler.

3. The connector as defined in claim 1, wherein each of the plurality of upwardly opening slots defines a seat upon which the terminal connector of a plurality of drape rods may be supported.

4. The connector as defined in claim 3, wherein each of the plurality of upwardly opening slots has an upper dimension greater than a dimension of the seat with the slots diverging away from the seat.

5. The connector as defined in claim 3, wherein the upwardly opening well is a longitudinal bore extending through the coupler.

6. The connector as defined in claim 1, wherein the flat-mounted connector is connected to the coupler via a connection bridge.

7. The connector as defined in claim 1, further comprising a second coupler, the second coupler being affixed to a connection bridge between the coupler and the second coupler.

8. The connector as defined in claim 7, wherein the coupler and the second coupler are disposed in series, the series extending in a direction normal to the surface plane of the flat-mounted connector.

9. The connector as defined in claim 1, wherein the coupler is made of a polymer material.

10. The connector as defined in claim 1, wherein the drape rod is a horizontally extending rod.

11. A method to couple rods, comprising:

affixing a flat-mounted coupler to a vertical surface via a wall connector, the flat-mounted coupler comprising two or more openings to receive two or more connector appliances to affix the flat-mounted coupler to a vertical flat surface, the flat-mounted coupler comprising an upper region connected to the wall connector, the upper region encompassing a well formed within a body of the upper region such that the well is an upwardly opening well when the flat-mounted connector is affixed to the vertical flat surface, the upper region defining a plurality of upwardly opening slots disposed within the upper region with each slot sized to receive therein a terminal connector of a rod, and the plurality of upwardly opening slots disposed to accept the terminal connector of the rod in parallel and perpendicular directions relative to a surface plane of the flat-mounted coupler when affixed to the vertical flat surface; and placing the terminal connector of the rod into the upwardly opening well such that the terminal connector is affixed to the flat-mounted coupler.

12. The method of claim 11, wherein placing the terminal connector of the rod comprises placing a hook end of the terminal connector into a particular upwardly opening slot of the upper region and allowing the hook end to lower into the body of the upper region until the hook end is affixed to a body of the flat-mounted coupler.

* * * * *